United States Patent [19]

Jones

[11] 4,425,660

[45] * Jan. 10, 1984

[54] SHIELDING ARRANGEMENT FOR A VACUUM FURNACE

[76] Inventor: William R. Jones, 244 Hampshire Dr., Chalfont, Pa. 18914

[ * ] Notice: The portion of the term of this patent subsequent to Mar. 31, 1998 has been disclaimed.

[21] Appl. No.: 275,870

[22] Filed: Jun. 22, 1981

[51] Int. Cl.[3] ..... F27D 11/00; H05B 3/00

[52] U.S. Cl. ..... 373/130; 373/112; 373/137

[58] Field of Search ..... 373/112, 130, 137; 219/347, 405, 355

[56] References Cited

U.S. PATENT DOCUMENTS 4,259,538 3/1981 Jones ..... 373/130

*Primary Examiner*—Roy N. Envall, Jr.

*Attorney, Agent, or Firm*—William E. Cleaver

[57] ABSTRACT

The present invention is directed to graphite shields (or shields of other materials which may react chemically or be oxidized in a vacuum furnace but which when condensed do not readily conduct electricity) or graphite shield liners used to protect electrical insulating devices from having electrical shorting path means develop thereon.

7 Claims, 3 Drawing Figures

SHIELDING ARRANGEMENT FOR A VACUUM FURNACE

BACKGROUND OF THE INVENTION

In my U.S. Pat. No. 4,259,538, entitled, "Vacuum Furnace Arrangement Having An Improved Heating Element Mounting Means", I described the problems that arise in connection with operating a vacuum furnace structure which has the insulating material and the heating element, or heating elements, mounted in the heating chamber of the vacuum furnace by a plurality of suitably attached molybdenum rods. The molybdenum rods are conductors of electricity and accordingly must be electrically insulated from the heating element which provides heat (by passing electrical current therethrough) in accordance with its electrical resistance characteristics ($I^2R$). It was determined by me at the time of the invention, described and claimed in the above mentioned patent, that electrical insulator devices should be employed to separate the molybdenum mounting rods from the heating element. It was also determined at that time that some of the work piece material evaporates and condenses on the insulator devices to provide a material buildup between the molybdenum rod and the heating element thereby providing a "short circuit". The above mentioned patent teaches the use of molybdenum shields to partially block the space between the molybdenum rod and the electrical insulator device so that no buildup of material can occur therebetween. At the same time said molybdenum shields intercept vaporized work piece material before it condenses on the outer surfaces of the electrical insulator devices. The foregoing described shields have worked out satisfactorily except in certain situations where the temperatures have been sufficiently high and the cycling time sufficiently long, so that the molybdenum shield material, per se, has vaporized and simultaneously the minute amounts of water vapor, (in what would otherwise be a true vacuum), have broken down into hydrogen and oxygen. It was principally the recognition of this last mentioned phenomenon that led to the conception of the present invention. After careful analysis it was determined that under the circumstances of high temperatures and relatively long cycling times, a certain amount of molybdenum from the molybdenum shields was in vapor form and the presence of the oxygen, from the water vapor, acted to oxydize such vaporized molybdenum. It was further determined that the electrical insulator devices have an affinity for molybdenum trioxide ($MO_3$). It was also discovered that while the molybdenum shields intercepted the vaporized work piece material such shields, per se, provided a buildup of $MO_3$. On subsequent cycles the $MO_3$ is reduced to leave molybdenum on the insulator surfaces and such a molybdenum buildup conducts electricity. The present invention serves to overcome that problem.

SUMMARY OF THE INVENTION

In one embodiment of the present invention there is provided a pair of graphite shields to be used in place of the molybdenum shields described above. In another embodiment graphite liners are secured to the sides of the above described molybdenum shields, that is to the sides which face the heating element and in yet another embodiment, the graphite liners are secured to the molybdenum shields as described earlier while in addition thereto graphite shields are located on both sides of the heating element facing the shield liners. In accordance with the present invention the graphite may chemically react and will oxydize in a manner similar to that described in connection with the molybdenum. However the resulting carbon compounds will not build up on the electrical insulator devices because said electrical insulator devices do not have an affinity for said carbon compounds.

The objects and features of the present invention will be better understood from the following description taken in conjunction with the drawings wherein.

Figure 1:
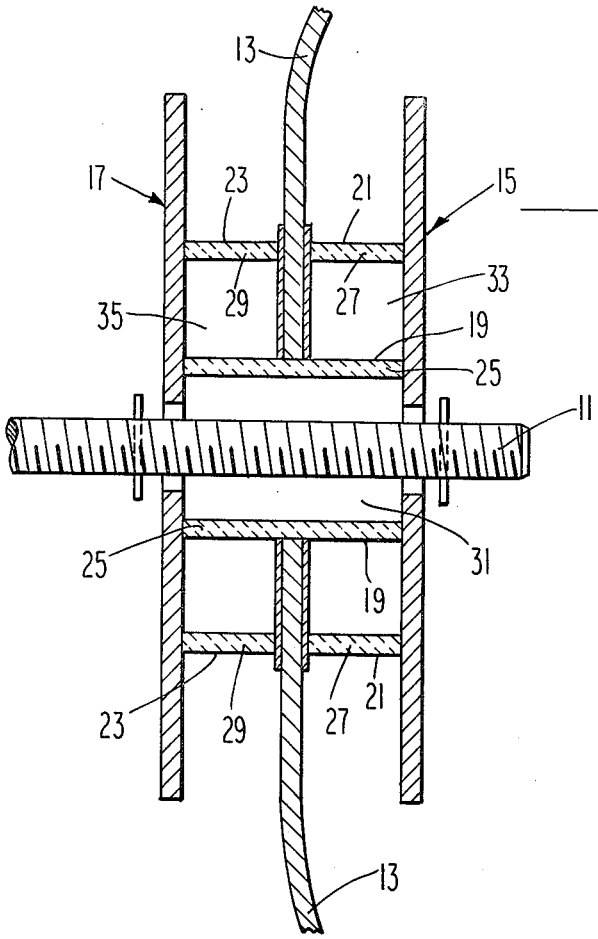
FIG. 1 depicts a pair of graphite shields disposed to fit over a tie rod and separated by insulators.

Consider FIG. 1. In FIG. 1, there is shown a tie rod 11 which serves to tie the heating element 13 along with all of the insulating elements and shields to the side wall of the heat chamber as taught by my U.S. Pat. No. 4,259,538. As explained in my aforementioned patent when work pieces become heated in the vacuum chamber, the work pieces vaporize to some degree and the material in vapor form condenses or coats the apparatus within the chamber. If the shields 15 and 17, shown in FIG. 1 were not present the vaporized work material would condense on the surfaces 19, 21 and 23, respectively, of the insulating sleeves 25, 27 and 29. In addition the vaporized work material would build up or coat the inside surfaces 31, 33 and 35 respectively, of the insulating sleeves 25, 27 and 29. These buildups of material have eventually caused shorting paths between the molybdenuum rod 11 and the metallic heating element 13.

As was explained in my aforementioned patent, shields 15 and 17, made of molybdenum, were provided to intercept the vaporized material which would normally have condensed on the insulating sleeves 25, 27 and 29. These shields have worked well for the most part, but I have found that if a work piece is being subject to temperatures in the high temperature range, eg. 1600° F. to 3000° F. for a relatively long cycle period or for many repeated short time cycles then the molybdenum shields per se, such as shields 15 and 17, oxidize to some extent. The situation is made worse because even though there is an apparent vacuum in the chamber, there nonetheless remains a certain amount of water vapor and other residual gasses. These minute amounts of gas add to the problem. For example, water vapor breaks down under the above mentioned temperatures and vacuum conditions into hydrogen and oxygen. I have determined that the oxygen combines with the vaporized molybdenum and condenses on the insulating sleeves 25, 27 and 29 as $MO_3$. While $MO_3$ is not a good electrical conductor it becomes readily reduced to molybdenum and hence shortening paths are developed between the molydenum rod 11 and the heating element 13. It should be noted that one of the principal reasons that the $MO_3$ (and after reduction molybdenum per se) can build up on the insulating sleeves 25, 27 and 29 is that the vaporized material from the shield is not blocked since the shields are located adjacent to the insulating sleeves.

I have found that if I replace the molybdenum shields 15 and 17 by graphite shields no shorting paths build up because even though the graphite vaporizes to some extent and is oxidized, the carbon compounds do not build up on the ceramic insulators 25, 27 and 29. The ceramic insulators do not have an affinity for these carbon compounds. Accordingly FIG. 1 can be viewed as having shields 15 and 17 made from graphite and the remainder of the structure as taught by my aforementioned patent.

I have further found that I can take advantage of the strength of molybdenum and it's good temperature characteristics if I simply provide graphite overlays or shields on the inside of the molybdenum shields.

Figure 2:
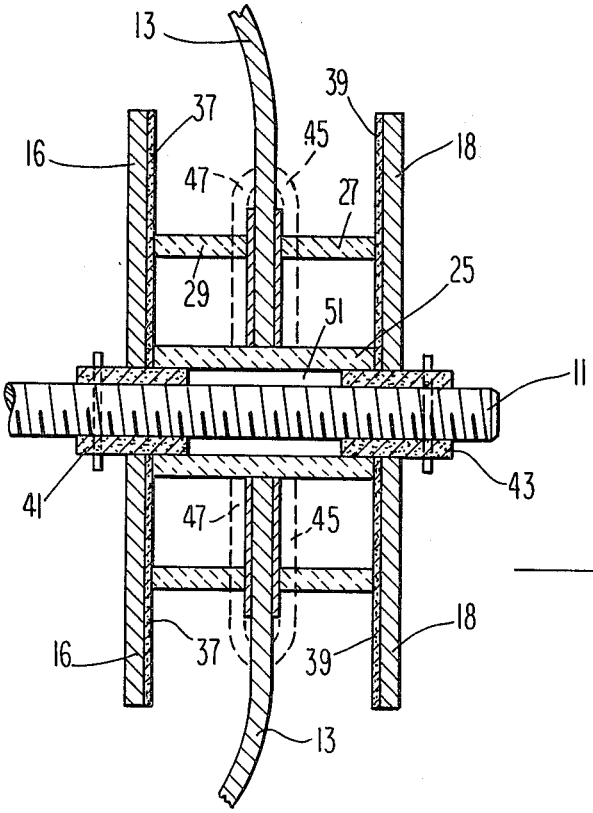
FIG. 2 depicts molybdenum shields having graphite liners and also depicts graphite plugs located within the insulator surrounding the tie rod as well as a possible graphite liner on the heating element.

As can be seen in FIG. 2 there are shown two molybdenum shields 16 and 18 to which there are respectively secured two graphite shield or overlays 37 and 39. The graphite shields 37 and 39 are secured to the molybdenum shields by a graphite cement or by mechanical means. In one embodiment the addition of the graphite shields 37 and 39 is all that would be changed.

In a third embodiment the graphite shields 37 and 39 would be added to the molybdenum shields 16 and 18 and in addition two graphite plugs 41 and 43 are employed. It should be understood that the plugs 41 and 43 can be in tube configuration, i.e. fill the entire space between the insulator 25 and the rod 11. The plugs 41 and 43 are inserted into the hollow section between the rod 11 and the insulator sleeve 25. The plugs 41 and 43 prevent any materials, molybdenum oxide or otherwise, from volatizing into the hollow section (either from the rod or the outside) and building up on the surface 31 of the insulating sleeve 25. The graphite plugs 41 and 43 of course do not provide any build up material on the sleeve 25 because as mentioned above the ceramic insulator sleeves 25, 27, and 29 do not have an affinity for carbon compounds.

Finally if we examine FIG. 2 again we find a fourth embodiment. In FIG. 2 it will be noted that there is shown in phanthom two layers 45 and 47 of graphite, secured to the heating element 13. The graphite layers 45 and 47 are secured to the heating element 13 by mechanical means. The graphite layers 45 and 47 serve to block heating element material from (condensing) onto the ceramic insulator. It should be noted that the sleeves 27 and 29 will abut the graphite layers 45 and 47 in this last described embodiment. It should be further understood that the graphite shields 37 and 39, the graphite plugs 41 and 43, and the graphite layers 45 and 47 can be used in any combination to prevent the build up of shorting paths. The combination of the graphite elements depends on the materials used, the temperatures employed, the cycle times and the cost factors.

Figure 3:
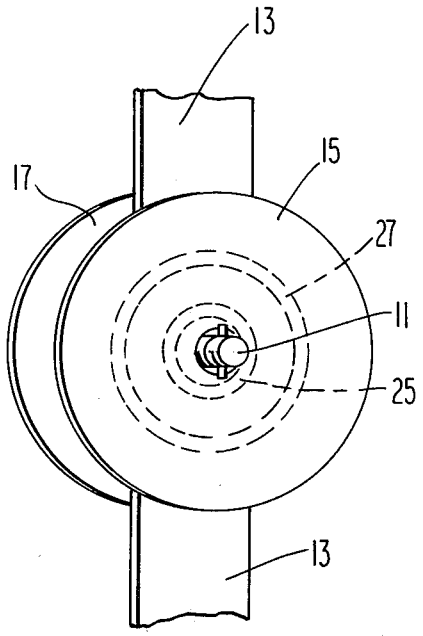
FIG. 3 is a reduced pictorial of the shield arrangement to enable a better understanding.

FIG. 3 shows a side pictorial arrangement so that the sectionalized views can be better understood. The elements of FIG. 3 are numbered the same as the elements of FIG. 1.

I claim:

1. In a vacuum furnace system, having a heating chamber, at least one heating element and a rod member passing through said heating element to provide a base means for securing said heating element to the wall of said heating chamber, an electrical insulating and support arrangement to be used with said rod comprising in combination: first electrical insulating means having first and second ends and formed to encompass a section of said rod and disposed to pass through said heating element; first and second shields, each formed and disposed to have said rod pass therethrough and further disposed so that said first shield is in substantial abutment with said first end of said first electrical insulating means and said second shield is in substantial abutment with said second end of said first electrical insulating means whereby one surface of each of said shields faces the other, said first and second shields being formed so that at least said facing surfaces are of graphite material; and means disposed with said rod to fix said shield in said substantial abutment with said first electrical insulating means.

2. An electrical insulating and support arrangement in a vacuum furnace system according to claim 1 wherein said first and second shields are fabricated entirely from graphite.

3. An electrical insulating and support arrangement in a vacuum furnace system according to claim 1 wherein there is further included graphite insertion means disposed to pass through said first and second ends of said first electrical insulating means between said first electrical insulating means and said rod to prevent material from volatizing therebetween.

4. An electrical insulating and support arrangement in a vacuum furnace system according to claim 1 wherein said first and second shields are each formed of at least two layers of material with the layer of each which provides one of said facing surfaces being formed of graphite.

5. An electrical insulating and support arrangement in a vacuum furnace system according to claim 1 wherein there is further included graphite layer means secured to said heating element in order to prevent heating element material from building up on said first electrical insulating means.

6. An electrical insulating and support arrangement in a vacuum furnace according to claim 1 wherein there is further included second and third electrical insulating means each of which is formed to encompass a different section of said first electrical insulating means, said second electrical insulating means disposed to lie between and to be in substantial abutment with said facing surface of said first shield and said heating element and said third electrical insulating means disposed to lie between and in substantial abutment with said facing surface of said second shield and said heating element.

7. An electrical insulating and support arrangement in a vacuum furnace according to claim 6 wherein there is further included graphite layer means secured to said heating element disposed to be between said second and third insulating means and said heating element and in substantial abutment with said second and third electrical insulating means.

* * * * *